United States Patent [19]

Kaneko et al.

[11] 4,336,770

[45] Jun. 29, 1982

[54] WASTE HEAT BOILER

[75] Inventors: Takayuki Kaneko; Sadami Ninagawa, both of Chiba, Japan

[73] Assignee: Toyo Engineering Corporation, Japan

[21] Appl. No.: 170,454

[22] Filed: Jul. 21, 1980

[30] Foreign Application Priority Data

Jul. 30, 1979 [JP] Japan ..... 54-96148

[51] Int. Cl.[3] ..... F22B 25/00

[52] U.S. Cl. ..... 122/266; 122/7 R; 122/53; 122/130; 122/269; 122/DIG. 13; 165/134 R; 165/160

[58] Field of Search ..... 165/134, 160; 122/53, 122/130, 266, 267, 268, 269, DIG. 13, 511, 512, 7 R

[56] References Cited

U.S. PATENT DOCUMENTS 3,070,537 12/1962 Treshon ..... 165/160 X
3,318,374 5/1967 Block ..... 165/134
4,140,176 2/1979 Essebaggers ..... 165/160 X

FOREIGN PATENT DOCUMENTS 190148 10/1907 Fed. Rep. of Germany ..... 122/266

*Primary Examiner*—Edward G. Favors
*Attorney, Agent, or Firm*—McGlew and Tuttle

[57] ABSTRACT

A waste heat boiler which comprises a water chamber and a water vapor chamber, both surrounded by an opposed pair of tube plates, respectively, and a plurality of double tubes extending across the two chambers. The inner tubes within the double tubes are adapted to pass hot waste gases therethrough, while annular spaces defined between the inner and outer tubes within the double tubes are for directing water to be heated therethrough. At least one end area of the double tubes is of triplicate structure so that thermal stresses generated from thermal expansion of the tube elements may be absorbed effectively.

8 Claims, 8 Drawing Figures

WASTE HEAT BOILER

BACKGROUND OF THE INVENTION (1) Field of the Invention

The present invention relates to a boiler and more particularly to a double-tube type waste heat boiler.

(2) Description of the Prior Art

Heretofore, from the standpoint of savings and recycling use of thermal energies, waste heat boilers have been put in use. With increasing interest in preservation and saving provoked by natural resources of late, there has been added the significance of waste heat boilers to cope with such circumstances and accordingly, it is so expected that the demands for large-sized, high-temperature and high-pressure designs of such waste heat boilers will become even greater hereafter. There are known general technical difficulties in the designs and constructions of waste heat boilers, among which the most common yet significant problems are such that tubings and tube sheets of the boilers subjected to hot gases are heated to high temperatures, thus inevitably resulting in the loss of strength thereof, and that stresses are produced due to differential thermal expansion from uneven temperature distribution in the metal parts organizing the boiler, i.e., a boiler drum, boiler tubes and tube sheets. In the attempt to meet such problems, as the boilers are recently designed to be larger and for use at high temperatures, reconsideration as to boiler design and construction, selection of suitable materials, increase in the material weight, troublesome and complex installation and inspection, etc., which would undoubtedly lead to increased costs and expenses in the manufacture, inspection and maintenance thereof must be considered. There are a variety of designs and constructions of waste heat boilers, among which the most typical one is such that there is provided a steel cylindrical shell or drum, having two tube sheets or plates with a plurality of openings welded or otherwise connected in an opposed relation with both ends of the boiler, and having a plurality of tubes within the boiler drum securely connected at each opening of the tube plate, respectively, wherein water is supplied from one end to the other of the boiler drum and high temperature waste gases are fed externally from one end tube plate through the plurality of tubes within the drum so as to provide heat to water within the drum and thus generate water vapor to be taken out from the other end of the drum and thereafter, the waste gases are directed outwardly from the opposite end tube plate to be discharged to a following processing step.

Now, referring to FIG. 3, a fragmentary cross-sectional view shows the conventional waste heat boiler in use and same is typically constructed in such a manner that there is a tube plate 21 connected at end of a boiler drum 20, the tube plate 21 having a plurality of tubes 22 rigidly connected thereto. There is provided a vacancy or space 24 defined by a channel 14 lined with an insulating or refractory material 15 on the exterior surface of the tube plate 21 as shown, into which high temperature waste gases are introduced and through the plurality of tubes 22 so as to be heated by transfer water within the drum 20, thereby generating water vapor. In such a construction, since the tubes 22 are subjected to high temperature gases while the boiler drum 20 is subjected to cold water, there is naturally a substantial difference in amounts of expansion between the drum 20 and the tubes 22 and as a result of such differential expansions, there occur substantial stresses at and near the connections between the plate 21 and the tubes 22 and the junction 23 between the plate 21 and the drum 20. It is noted that when there is a great difference in temperatures of the waste gases and water, or when the drum 20 or the tubes 21, having a substantial thickness, are under high water pressure, or when a waste heat boiler is of a large size, large amount of stress increases to such an extent that same eventually becomes an obstacle to the design thereof. In the case where it is of a high-pressure design, there is further stress from the increased inner pressure in addition to the stresses caused by the thermal expansion mentioned above and thus particularly resulting in further total stress at and near the junction part 23. Consequently, there is induced complexity in the configurational and structural designs of and around the junction part 23, which further makes it necessary to severely analyze possible fatigues of the material therearound, thus bringing technical difficulties in the selection of material to be used as well as in such field operations as manufacturing inspection, repairing, and so on, thus resulting in eventual increased costs and expenses of manufacture and maintenance of the boilers. Also, the tube plate 21 is designed to face high temperature gases through the refractory material 15, but still heated to a substantially high temperature on the face thereof and therefore, it would be likely lose its strength. Consequently, it is generally necessary to design the tube plate to be substantially thick, however, such a thick tube plate would necessarily bring reduced efficiency in cooling which would be effected by water behind this thick plate, thereby possibly causing the temperature of the tube plate to be further higher. For the practical design of a boiler, it is therefore essential to resolve all such technical problems.

SUMMARY OF THE INVENTION

It is therefore a primary object of the present invention to provide an improved double-tube type waste heat boiler that can solve the problems as encountered in the conventional boilers as stated above, that provides a unique construction to substantially save material to be used and is easy to assemble and install.

It is another object of the invention to provide an improved waste heat boiler having a heat exchanging section of a tubular construction that does not require a thick boiler drum. It is a further object of the invention to provide an improved waste heat boiler having less heat stresses in construction, making it possible to use relatively thin material for the design of the tube plates thereof.

A better understanding of the principles and advantages, together with the above and further objects of the present invention may be had after consideration of the detailed description of the invention with reference to the accompanying drawings, in which like parts are designated with like reference numerals.

DETAILED DESCRIPTION OF THE INVENTION

The present invention will now be described in detail by way of examples, yet not restrictive thereto, in conjunction with the accompanying drawings.

Figure 1:
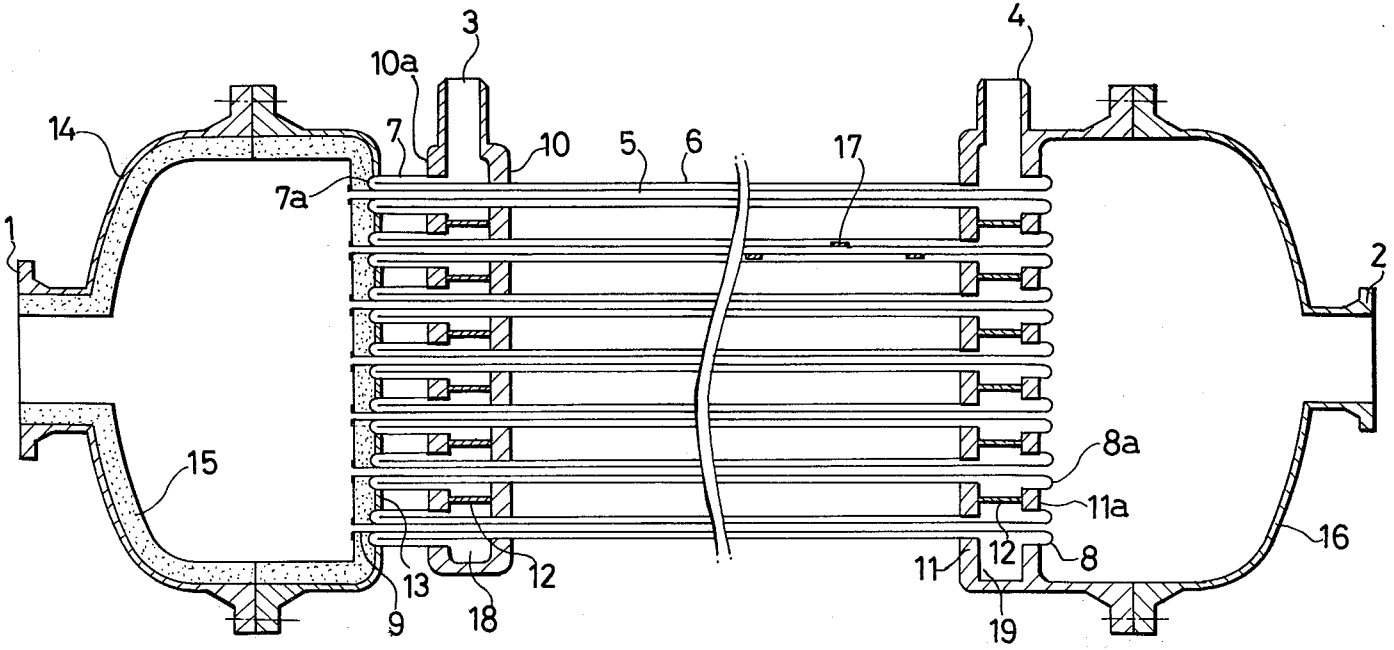
FIG. 1 is a longitudinal cross-sectional view showing a waste heat boiler according to the present invention.
Figure 2A:
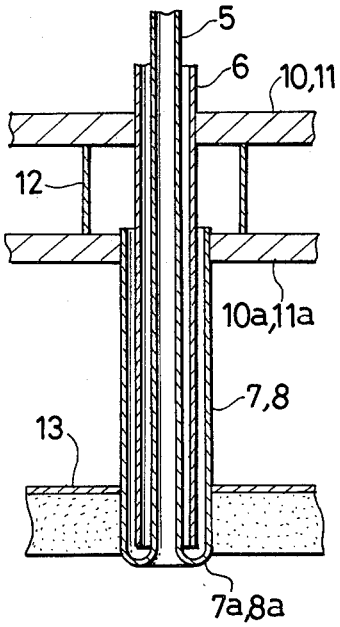
FIGS. 2(*a*) through 2(*e'*) are schematic illustrations showing, in fragmentary cross-section, a variety of junctions between the boiler tubes and the tube plate of the waste heat boiler of this invention by way of a preferred embodiment thereof.
Figure 2B:
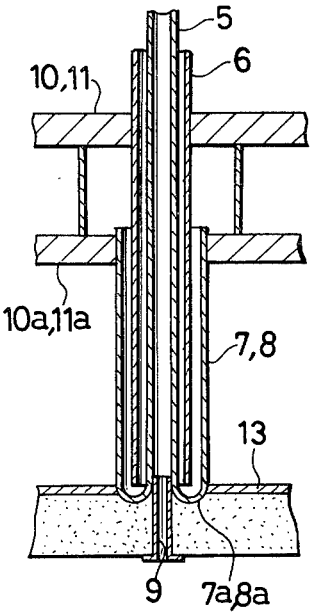
Figure 2C:
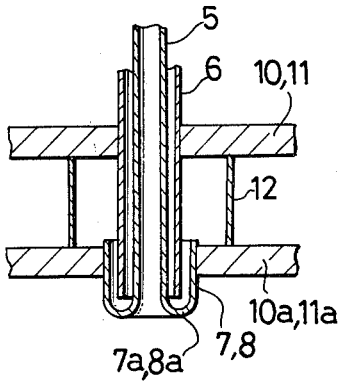
Figure 2D:
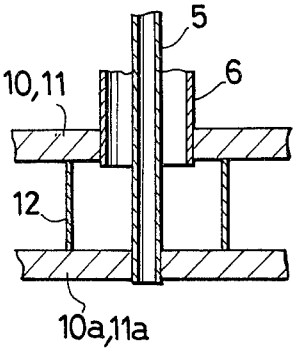
Figure 2E:
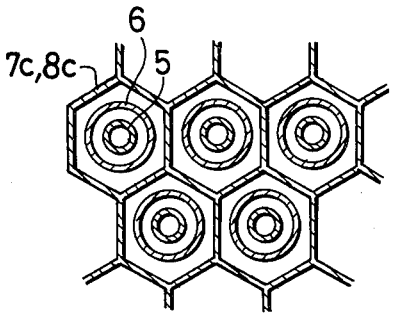
Figure 2E:
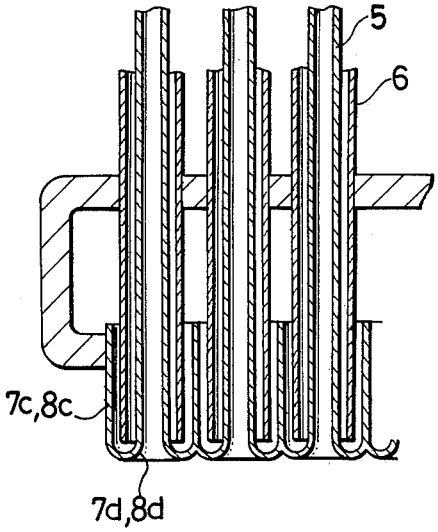

Firstly, referring to FIG. 1, there is generally shown in a longitudinal cross-section the improved waste heat boiler of this invention, wherein there is provided a gas inlet channel 14 having an inlet for supply of hot gases 1, and the gas channel is lined with a refractory material 15, as necessary. More particularly, one end of each of a plurality of inner tubes or inner tube group 5 for introducing high temperature waste gases thereinto opens at the end wall surface of the gas inlet channel 14 through a tube ferrule 9, while the other end thereof opens at a tube plate 11*a* on the end wall of a waste gas outlet channel 16 through an annular-shaped gap therewith. There is disposed a water chamber 18 surrounded by tube plates 10, 10*a* and near the inlet channel 14, a plurality of outer tubes or outer tube group 6 extending in closely fitted relation through the tube plate 10. The outer tube group 6 extends through the tube plate 10*a* through annular gaps therewith. Also, there are a plurality of outermost tubes 7 extending around the outer circumferences of the outer tubes on the inlet channel side and through annular gaps therewith, the annular gaps opening to the water chamber 18 through the tube plate 10*a*. The free ends of the outermost tubes 7 and the inner tubes 5 are hermetically connected with a plurality of caps 7*a* of semi-torus or semi-doughnut shape, respectively. There is provided a water passage or gap between the end of each outer tube 6 on the side of the inlet channel 14 and the interior surface of each cap 7*a* stated above. A water inlet 3 is provided at the top of the water chamber 18. On the other hand, there is provided a gas outlet 2 in the gas outlet channel 16 and there is also provided a water vapor chamber 19 between the tube plate 11*a* on the end surface of the channel and another tube plate 11 disposed outwardly in parallel relationship therewith. Likewise, there is an annular gap between each of an outermost tube 8 and the inner tubes 5, respectively, each of the outermost tubes 8 extending through the opening in the tube plate 11*a* in dual concentric relation with each of the inner tubes 5. The above mentioned annular gap is hermetically connected with a semi-torus-shaped cap 8*a* between the ends of the inner tube 5 and the outermost tube 8. Also, in the tube plate 11, the inner tube 5 extends through an annular gap therearound, the circumference of the opening of the tube plate 11 through which the inner tube 5 extends being connected sealingly to the end of the outer tube 6. There is provided a water vapor outlet 4 in the water vapor chamber 19. In the inside of the water chamber 18 and the water vapor chamber 19, a plurality of stays 12 are provided tying across the both tube plates thereof together, respectively. Also in the annular gaps defined between the inner tubes 5 and the outer tubes there are inserted a plurality of spacers 17, respectively.

Now, the operation as featured in the present invention will be described as to the embodiment thereof as shown in FIG. 1. Hot waste gases fed into the inlet channel 14 through the gas inlet 1 are directed into the inner tube group 5 through the tube ferrules 9 so as to exchange heat while passing therethrough, thereafter entering into the gas outlet channel 16 to be discharged from the outlet 2. Concurrently, water is directed into the water chamber 18 through the water inlet 3 so as to fill up with the chamber, and then introduced into the annular gaps between each of the outermost tubes 7 and the outer tubes 6, passing through the semi-torus gaps between the caps 7*a* and the ends of the outer tubes 6 into the annular gaps between the outer tubes 6 and the inner tubes 5, where the water is heated with the hot waste gases passing through the inner tubes 5, thus becoming water vapor. Thus-produced water vapor and hot water are now directed to enter the vapor chamber 19 and eventually be discharged out of the vapor outlet 4. By virtue of such advantageous construction of this invention in that the high temperature inner tubes and the relatively low temperature outermost tube 7 are connected operatively with the caps 7*a* on the side of the inlet channel 14, thermal expansion from the temperature difference existing in both tubes 5 and 7 may effectively be absorbed by function of these caps 7*a*. On the other hand, the caps 8*a* on the side of the outlet channel 16 function in a like manner to absorb the thermal expansion occurring there, so that there is observed less stress to be caused by the differential thermal expansion from the temperature differences in each of the tube plates 10, 10*a*, 11 and 11*a* from that of the inner tubes 5. These caps 7*a* and 8*a* may be designed selectively in consideration of the operating temperatures of hot gases and water, and the thermal expansion involved in use, as will be described further later. While the temperature of the tube plate on the gas inlet side is observed to be so high due to contact with hot waste gases in conventional designs and constructions of waste heat boilers, the tube plate 10*a* according to this invention is advantageously kept away from direct contact with the hot waste gases, thus resulting in a relatively small temperature rise of the tube plate and therefore, it is not necessary to consider any substantial strength loss caused by a considerable temperature rise during the operation of the tube plate 10*a* in the determination of a thickness thereof.

Figure 3:
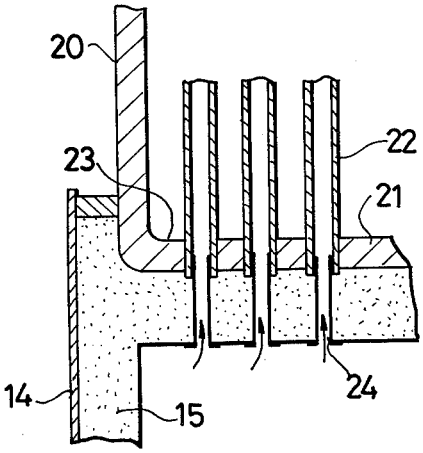
FIG. 3 is a cross-sectional view showing a part of a waste heat boiler of typically conventional construction.

Incidentally, according to the typical conventional design of a waste heat boiler, as typically shown in FIG. 3, it is noted that there exists the junction part between the high temperature gas tubes and the tube plate on the gas inlet side where there are low-temperature and high-pressure water and high-temperature and low-pressure gases. In contrast, according to the advantageous construction of the present invention, each of the tube plates of the boiler is effectively designed not to directly contact the hot gases and the hot gas tubes 5 and further, each of these is positively reinforced by way of stays as shown in FIG. 1. Consequently, it is now practicable to have relatively thin tube plates made available for use under high pressure and concurrently, to have an appreciable extent of savings in manpower and materials required in the manufacture of a waste heat boiler. The near end area of the tube 5 in which the hot gases pass is cooled off by constantly flowing cold water and this area is thin in thickness so that it has an efficient cooling effect. Further, it is flexible enough to absorb thermal stress existing there. Also, this area has no stagnancy since there is a relatively high flow rate of water, thus providing a cleaning effect by the stream of water, which high flow rate of water advantageously effects the prevention of scales from depositing thereabout which is quite undesirable yet inevitable in waste heat boilers. With such tubular construction in the heat exchanging section of this boiler, it is not necessary to provide a very thick boiler drum construction as in the conventional waste heat boilers and consequently, there is provided no junction part of the drum and tube plates which has contingently presented troubles from thermal stresses existing thereabout, thereby relieving this particular area from the generation of questioned stresses and contributing substantially to the materialization of a light-weight boiler. For affording a high inner pressure in use, there are provided a series of stays 12 with an effect of reducing a design thickness of the tube plate. Also, the provision of spacers 17 between the inner and outer tubes effects the prevention of vibration and/or eccentricity of these tubes with each other during the operation.

Next, some typical examples of the junction part between the individual tube and the tube plate according to this invention will now be described as follows. Firstly, referring to FIGS. 2(*a*) and 2(*b*), there are shown an embodiment such that the tube plate 13 on the hot gas supply side is lined with an insulating or refractory material for the purpose of keeping the temperature of the tube plate 13 at a relatively low level. More particularly, FIG. 2(*a*) shows a construction where there is provided the outermost tube 7 extending completely through the refractory material layer to the surface thereof, FIG. 2(*b*) showing one wherein the outermost tube 7 terminates at the surface of the tube plate with the ferrule 9 extending between the inner surface of the refractory material layer and partly the entrance end of the tube 5 as shown in an attempt to effect a smooth flow of hot gases and to prevent possible damage of the castable refractory material caused by errosion. Also, in the design shown in FIG. 2(*b*), it is further advantageous that the tube end may be kept at a relatively low temperature by the provision of refractory material in comparison with the case of FIG. 2(*a*). Next are still other embodiments of the invention shown in FIGS. 2(*c*) and 2(*d*) wherein the tube plate 13 is omitted in construction, and this feature may be applied particularly in the case that the temperature of hot gases is relatively low, or at a gas outlet section and the like. Moreover, according to the constructions shown in FIGS. 2(*a*), 2(*b*) and 2(*c*), there is provided the cap 7*a* or 8*a* joining the outermost tube 7 or 8 and the inner tube 5, respectively, serving as a flexible joint that can effectively absorb a thermal expansion to exist in the outer tube 6 and the inner tube 5. On the other hand, FIGS. 2(*e*) and 2(*e'*) illustrate further constructions such that there are provided outermost tubes 7 or 8 and caps 7*a* or 8*a* having a regular hexagonal shape in cross-section, respectively, in an attempt that they may be arranged snugly adjacent to each other free from any gaps therebetween, so that they can be accommodated in the highest number within a given area, accordingly. That is, these parts are formed with tubes 7*c*, 8*c* of a honeycomb structure. This specific structure can readily be formed by arranging and welding constituent elements to be hexagonal in cross-sectional shape. For the connection of the inner tube 5 to the hexagonal outermost tube 7*c* or 8*c*, there is provided a cap 7*d* or 8*d* having a hexagonal cross-sectional shape at its opening base and this cap may be welded in position to surround the ends of these tubes. These caps 7*d*, 8*d* serve as a flexible joint like those 7*a*, 8*a* described in conjunction with the foregoing embodiment. It is also possible to provide the refractory material and/or tube ferrules in the like manner as in the embodiment shown in FIG. 2(*b*).

As fully stated hereinbefore, there are a variety of structures of stream distribution and collection at the junction parts between the tubes and tube plate and therefore, it is now practicable to combine at choice such variations in the determination of an optimal structure under a given design condition.

Needless to mention, the improved construction of a waste heat boiler according to this invention can be applied satisfactorily to a general heat exchanger other than the application as described herein by way of preferred embodiments thereof.

While the present invention has been described in detail by way of specific preferred embodiments thereof, it is obvious to those skilled in the art that many other modifications and variations may be made without departing from the spirit and scope of the invention. Accordingly, it is to be understood that the present invention is not restricted to such variations, but is covered only by the appended claims.

What is claimed is:

1. A double-tube type waste heat boiler comprising, in combination, water chamber means; water vapor chamber means; both said chamber means being surrounded by an opposed pair of tube plates, respectively; a plurality of inner tube means extending in communication with and between a gas inlet channel means and a gas outlet channel means; a plurality of outer tube means arranged with one extending in concentric relation with each of said plurality of inner tube means with an annular gap therearound; a plurality of outermost tube means arranged with one extending in concentric relation with each of said plurality of inner and outer tube means with an annular gap therearound in such a manner that the tube end areas of said plurality of outermost tube means and said plurality of inner and outer tube means may be of a triplicate structure at least on the side of the gas inlet channel; and a plurality of annular or torus cap means connecting hermetically the ends of each of said plurality of outermost tube means and of each of said plurality of inner tube means in such a manner that an annular gap defined by and between each of said plurality of inner tube means and said plurality of outer tube means and an annular gap defined by and between each of said plurality of outer tube means and said plurality of outermost tube means communicate with each other at the tube ends thereof.

2. The waste heat boiler as claimed in claim 1, wherein the inner surface of said gas inlet channel means is lined with an insulating or refractory material.

3. The waste heat boiler as claimed in claim 1 or 2, wherein there are provided a plurality of stays rigidly connected to and extending across the opposed inner surfaces of said tube plates of said water chamber and water vapor chamber means.

4. The waste heat boiler as claimed in claim 2 or 3, wherein said tube end areas of triplicate structure extend completely through the refractory lining of said gas inlet channel means so as to be subjected to hot waste gases.

5. The waste heat boiler as claimed in claim 2 or 3, wherein said tube end areas of triplicate structure are disposed in the refractory lining of said gas inlet channel means and there are provided a plurality of ferrule means extending in communication with and between said inner tube means in said triplicate structure and said gas inlet channel means through the refractory lining of said gas inlet channel means.

6. The waste heat boiler as claimed in claim 2 or 3, wherein said tube end areas of triplicate structure project immediately from the outer tube plates of said water chamber means and/or said water vapor chamber means, respectively.

7. The waste heat boiler as claimed in claim 2 or 3, wherein the tube end areas of double-tube structure open at the outer tube plate of said water chamber means and/or said water vapor chamber means.

8. The waste heat boiler as claimed in claim 2, 3, 4, 5, or 6, wherein said outermost tube means of triplicate structure are formed in honeycomb fashion so that they may be arranged snugly adjacent to each other without any gaps therebetween.

* * * * *